US010957504B1

(12) United States Patent
Shea

(10) Patent No.: US 10,957,504 B1
(45) Date of Patent: Mar. 23, 2021

(54) ARC CHUTE FOR CIRCUIT PROTECTIVE DEVICES

(71) Applicant: Schneider Electric USA, Inc., Andover, MA (US)

(72) Inventor: John J. Shea, Wake Forest, NC (US)

(73) Assignee: Schneider Electric USA, Inc., Boston, MA (US)

( * ) Notice: Subject to any disclaimer, the term of this patent is extended or adjusted under 35 U.S.C. 154(b) by 0 days.

(21) Appl. No.: 16/729,926

(22) Filed: Dec. 30, 2019

(51) Int. Cl.
*H01H 33/08* (2006.01)
*H01H 33/53* (2006.01)
*H01H 33/70* (2006.01)

(52) U.S. Cl.
CPC ..... *H01H 33/08* (2013.01); *H01H 33/53* (2013.01); *H01H 33/7015* (2013.01)

(58) Field of Classification Search
CPC ..... H01H 33/08; H01H 33/18; H01H 33/182; H01H 33/185; H01H 33/53; H01H 33/7015; H01H 2003/085; H01H 9/34; H01H 9/345; H01H 9/346; H01H 9/362; H01H 9/44; H01H 9/443; H01H 2009/365
USPC .... 218/15, 22–26; 335/38, 84, 91, 133, 135, 335/136, 153, 201, 202, 302
See application file for complete search history.

(56) References Cited

U.S. PATENT DOCUMENTS 6,248,970 B1 * 6/2001 DiMarco ..... H01H 9/34 218/149
7,186,941 B2 * 3/2007 Yeon ..... H01H 9/302 218/149
7,488,915 B2 * 2/2009 Pollitt ..... H01H 9/342 335/201
7,705,263 B2 * 4/2010 Rane ..... H01H 9/34 218/149
8,222,555 B2 * 7/2012 Schaltenbrand ..... H01H 9/362 218/34
9,343,251 B2 * 5/2016 Juds ..... H01H 9/36
2006/0266738 A1 * 11/2006 Kinzler ..... H01H 71/0207 218/22
2011/0259852 A1 * 10/2011 Rival ..... H01H 9/342 218/150

* cited by examiner

*Primary Examiner* — William A Bolton
(74) *Attorney, Agent, or Firm* — Locke Lord LLP

(57) ABSTRACT

An arc chute includes a pair of opposing side walls and a non-magnetic body. The side walls are formed of an electrically insulating material. The non-magnetic body includes an open area and a plurality of slots through which to facilitate gas flow. The arc chute also includes a back wall arranged on a back side of the non-magnetic body and including at least one first insulator and at least one magnet. The at least one first insulator is arranged between the at least one magnet and the open area and configured to electrically isolate the magnet from the non-magnetic body. The magnet is configured to generate a magnetic field to redirect an arc in the open area toward one of the side walls.

20 Claims, 9 Drawing Sheets

Top Sectional View of Back Insulator

Single Vertical magnet

B-Field Lines for One Magnet

Side-View w/o Showing Insulator

ARC CHUTE FOR CIRCUIT PROTECTIVE DEVICES

TECHNICAL FIELD

The present disclosure relates an arc chute for circuit protective devices, and more particularly, to an arc chute with one or more permanent magnets to direct arcing toward a side wall of the arc chamber.

BACKGROUND

Circuit breakers are used to interrupt current flow in the event of abnormal operating conditions, such as a short circuit or current overload. To interrupt current flow, electrical contacts are separated. Electrical arcing may occur between the contacts as they are separated, resulting in potential damage to the contacts as well as other components in the circuit breaker from electrical and heat energy generated from arcs or arcing. The quick extinction of this arc is desired not only to minimize damage to the circuit breaker but to interrupt the current as quickly as possible to protect the wires and load. AC circuits are generally used in many of today's power systems however, DC circuits are becoming more popular due to the use of batteries, DC converters, LED lighting, DC motors, and photovoltaic arrays all of which are inherently DC powered. And since a DC circuit is more difficult to interrupt current flow as compared to an AC circuit due to the natural current zero crossing inherent in an AC circuit, the traditional circuit breakers designed for use in an AC circuit have a difficult time interrupting a DC circuit. So, there is a need for a circuit protective device which can efficiently interrupt DC and protect a DC circuit.

SUMMARY

In accordance with an embodiment, an apparatus is provided for extinguishing an arc. The apparatus can include an arc chute that can include a pair of opposing side walls, a non-magnetic body arranged between the side walls, and a back wall arranged on a back side of the non-magnetic body. The side walls are formed of an electrically insulating material. The non-magnetic body has an open area and a plurality of slots through which to facilitate gas flow. The back wall includes at least one first insulator and at least one magnet. The at least one first insulator is arranged between the at least one magnet and the open area and configured to electrically isolate the magnet from the non-magnetic body. The magnet can generate a magnetic field to redirect an arc in the open area toward one of the side walls, depending on current direction.

The side-walls can be formed by inserting the arc chute inside of the arc chamber or there may be side walls created from an insulating material which can also be used to support the metal arc plate stack.

In various embodiments, the non-magnetic body can be a non-ferromagnetic body, which comprises a plurality of stacked metal plates that are spaced-apart to form the plurality of slots therebetween. Each plate of the plurality of stacked metal plates can have a pair of arms extending from a base which is connected therebetween. The open area is formed between the pair of arms of the stacked metal plates. Each plate of the plurality of stacked metal plates can have a U-shaped profile or a π-shaped profile.

The at least one first insulator can include a plurality of spaced apart grooves or recesses configured to engage and support an outer surface of the base of corresponding plates from the plurality of stacked metal plates, and is configured to support the at least one magnet. The at least one first insulator can also include one or more vent openings through which to facilitate gas flow out from the open area. The at least one magnet can have a first end and an opposite second end. The first and second ends can each have an opposite magnetic polarity with one of the first or second end facing toward the open area across the at least one first insulator.

The at least one first insulator can also include at least one pocket for supporting the at least one magnet. The at least one first insulator can further include one or more vent openings through which to facilitate gas flow out from the open area, the at least one magnet comprises a plurality of magnets, and the at least one first insulator includes a plurality of pockets for supporting the plurality of magnets at different locations. The plurality of pockets can be separated by the one or more vent openings.

The apparatus can further include a pair of second insulators each including a plurality of spaced apart grooves or recesses configured to engage and support corresponding plates from the plurality of stacked metal plates. Each second insulator can be engaged to the plurality of plates of a respective one of the pair the side walls. Furthermore, each of the pair of second insulators can be configured to engage an open end of a corresponding arm of the pair of arms. The arc chute can also include at least one side gas channel. The first and/or second insulators can comprise of nylon.

In another embodiment, a circuit protective device is provided, which includes a first electrical contact, and a movable second electrical contact, which when engaged with the first electrical contact, is configured to enable current flow thereacross to a circuit. The circuit protective device can further include the apparatus for extinguishing an arc or an arc chute, such as described herein. The circuit protective device can include a case for housing the first and second electrical contacts and the arc chute. The side walls of the arc chute of the apparatus can be formed as part of the case or side walls of an arc chamber in the case. The circuit protective device can be a bi-directional DC circuit breaker or still function as an AC circuit breaker.

BRIEF DESCRIPTION OF THE DRAWINGS

A more detailed description of the disclosure, briefly summarized above, may be had by reference to various embodiments, some of which are illustrated in the appended drawings. While the appended drawings illustrate select embodiments of this disclosure, these drawings are not to be considered limiting of its scope, for the disclosure may admit to other equally effective embodiments.

Identical reference numerals have been used, where possible, to designate identical elements that are common to the figures. However, elements disclosed in one embodiment may be beneficially utilized on other embodiments without specific recitation.

DETAILED DESCRIPTION

Figure 1:
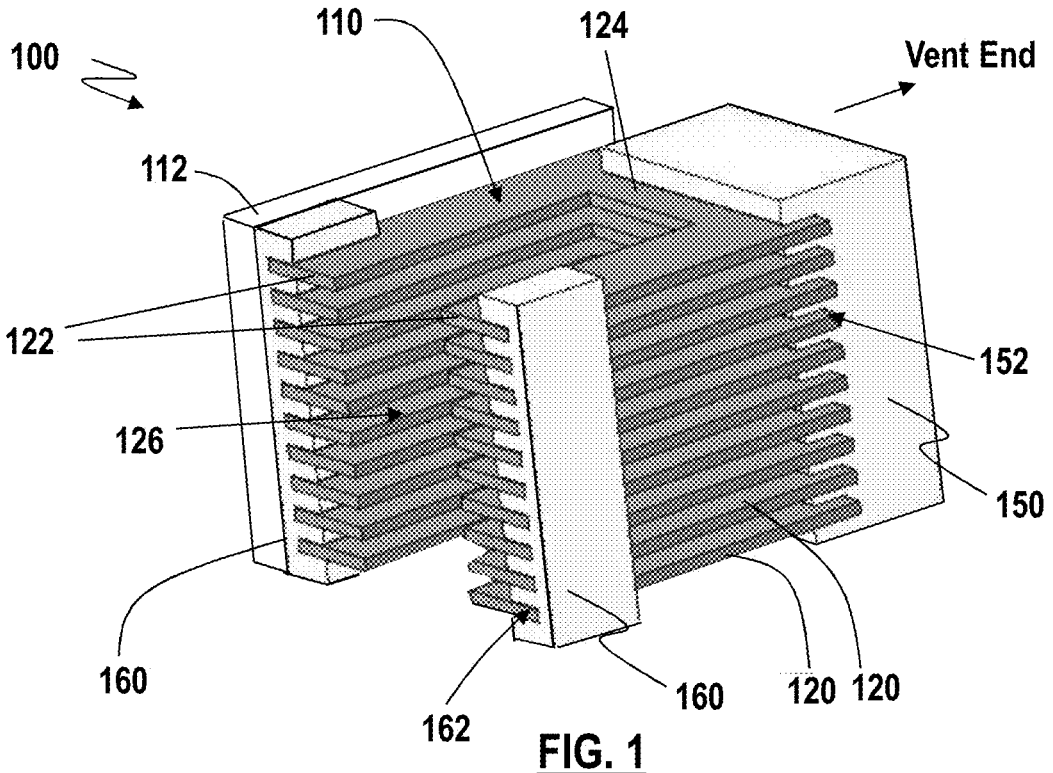
FIG. 1 is a perspective view of an arc chute for a circuit protective device, such as for example a DC circuit breaker, in accordance with a first embodiment.

The present disclosure relates to an arc chute for a circuit protective device, such as a circuit breaker. The arc chute includes a pair of opposing side walls, a back wall and a non-magnetic body for extinguishing an arc. The non-magnetic body is arranged between the side walls and back wall, and includes an open area (or space), also referred to as an arc quenching chamber. The back wall (e.g., toward a vent side) can include a back insulator to support and electrically isolate one or more magnets from the pair of side walls. The one or more magnets on the back wall can generate a magnet field to redirect arcing in or around the open area toward one of the side walls of the arc chute, such as for example due to disengagement of electrical contacts of the circuit protective device. The non-magnetic body can include a stack of non-magnetic metal plates (e.g., non-ferromagnetic plates, etc.), which are spaced-apart to provide a plurality of slots through which to facilitate the flow of gas (or gas flow), such as produced as a result of arcing, out from the open area of the non-magnetic body between the opposing side walls. The arc chute can also be designed with gas channels on an outer side surface and/or outer back surface of the non-magnetic body to control or facilitate movement of gas flow to one or more vents or venting components of the circuit protective device.

Such an arc chute configuration with the magnet(s) arranged at a back (or vent-side) of the arc chute can break-up arcs quickly and effectively through the use of magnetic fields to redirect an arc(s) to one of the side walls, where the slotted design can also help to extinguish arcs. Furthermore, such an arc chute configuration is more versatile than an arc chute that employs magnets on the sides of the chute to redirect arcing towards a back of the chute. An arc chute with magnets on the sides can be used primarily with unidirectional circuit breakers, e.g., where current flow is in one direction (or polarity) through a circuit protective device. In contrast, the arc chute configuration of the present disclosure can be used with bi-directional circuit breakers in which the terminals are interchangeable, e.g., first and second terminals are connectable to the load and line wiring respectively, or vice-a-versa. By positioning the magnet(s) at the back of the arc chute, arcs in a bi-directional circuit breaker can be redirected to one or the other of the side walls of the arc chute according to the direction (or polarity) of current flow through the circuit breaker. The arc chute configuration of the present disclosure can also incorporate gas channels to direct or facilitate movement of gases to the vent(s) of the circuit breaker or arc chamber which includes the arc chute, the vent and electrical contact assembly. The arc chute configuration can also incorporate one or more insulators to support the non-magnetic body or portions thereof (e.g., a stack of non-magnetic or deionizing plates), and insulator materials such as nylon or other materials which can produce gases as a result of arcing to further help extinguish an arc(s) and to cool down the arc chute. The magnetic field created by the permanent magnet also serves to cool the arc by increasing convective losses due to the increased turbulence produced by the magnetic field produced by the permanent magnet. The faster the arc can be cooled, the quicker and more efficient the arc extinction process becomes. Various arc chute designs or configurations will be described in greater detail below with reference to the figures.

Figure 2:
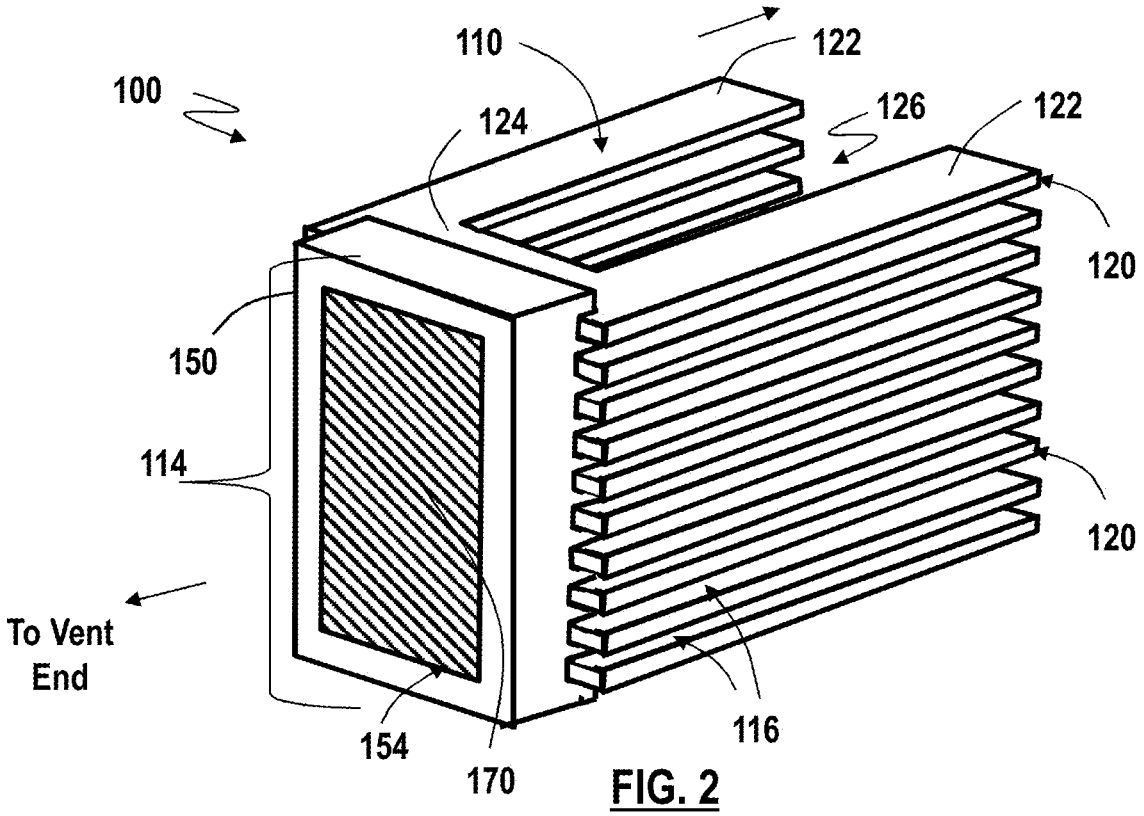
FIG. 2 is another perspective view of the arc chute of FIG. 1, with the side insulators removed, in accordance with the first embodiment.

FIGS. 1 and 2 show front and back perspective views of an arc chute 100 in accordance with a first embodiment. The arc chute 100 can be employed in a circuit protective device to extinguish an electric arc which may result from operation of the circuit protective device, such as the engagement or disengagement of electrical contacts therein. The circuit protective device can be a circuit breaker, such as an AC or DC circuit breaker, a contactor, or other circuit protective device. The arc chute 100 includes a non-magnetic body 110 for extinguishing an arc, a pair of opposing side walls 112, and a back wall 114. The non-magnetic body 110 includes a plurality of slots 116 for facilitating gas flow, and an open area (or space) 126. The non-magnetic body 110 is arranged between the side walls 112. The side walls 112 can be formed of an electrically insulating material, such as a non-magnetic or other insulating material (e.g., fiberboard or glass polyester). The back wall (or vent end) 114 includes a back insulator 150 to support at least one magnet 170 (e.g., a permanent magnet), and to electrically isolate the magnet 170 from the non-magnetic body 110. The magnet 170 can be retained in a pocket 154 (e.g., pocket, recess or recessed area, etc.) of the back insulator 150. As will be described further below, the magnet 170, which is arranged at the back of the arc chute 100, is configured to generate a magnet field(s) to redirect arcs generated in or around the open area 126 toward one of the side walls 112 (or one of the sides of the non-magnetic body 110).

In this example, the non-magnetic body 110 can be formed of a plurality of stacked plates 120 (e.g., deionizing plates) which are spaced-apart from each other to form the plurality of slots 116 (e.g., slots, openings, through-holes, etc.). For example, each of the plates 120 of the body 110 can include a base 124 and a pair of opposing arms 122 which extend from the base 124. The open area 126 is formed or provided between the pair of opposing arms 122 of the stacked plates 120. The non-magnetic body 110 and its plates 120 can have a U-shape profile. The plates 120 can be made of a non-magnetic material such as non-ferromagnetic material, non-magnetic steel (e.g., 304 or 316 stainless steel) or other non-magnetic metals (e.g., copper, brass, etc.), and can be formed by stamping, molding or other manufacturing techniques to obtain a desired shape.

Figure 3:
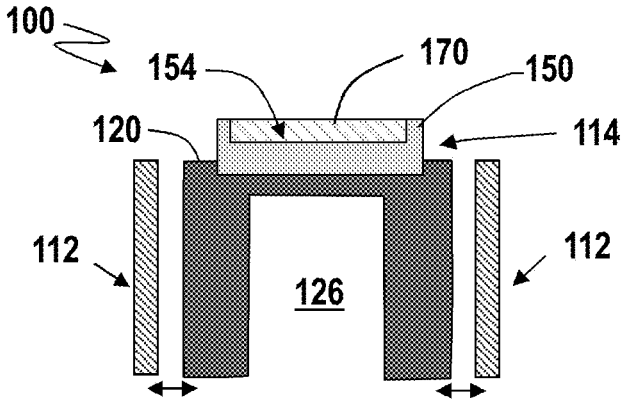
FIG. 3 is a top-sectional view of the arc chute of FIG. 2 in accordance with the first embodiment.
Figure 4:
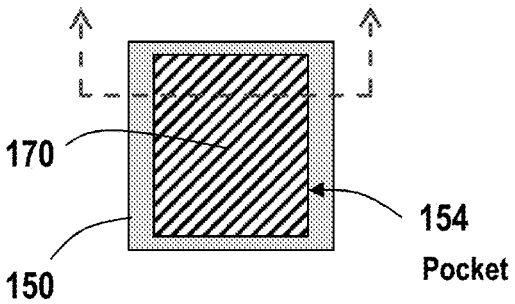
FIG. 4 is a partial back view of the arc chute of FIG. 2 showing the back insulator with a magnet in accordance with the first embodiment.

As further shown, the arc chute 100 can utilize the back insulator 150 and front (or side) insulators 160 to support the plates 120 of the body 110. For example, the back insulator 150 and front insulators 160 can include a plurality of spaced-apart grooves or recesses (e.g., blind slots, etc.) 152 and 162 respectively, which are configured with a size and shape to engage and support corresponding plates from the plurality of stacked plates 120. Each front insulator 160 can be positioned (or arranged) on an outer side surface or portion at or around an open end of each of the pair of side walls 112. The insulators 150 and 160 can be formed of an electrically insulating material to electrically isolate the magnet 170 from the non-magnetic body 110 and its component(s). The insulators 150 and 160 can also be formed of a suitable material (e.g., nylon, nylon composite, etc.) which can produce gases as a result of arcing to help extinguish an arc and to cool down the arc chute. Furthermore, as shown in FIGS. 3 and 4, the back insulator 150 can include at least one pocket 154 for supporting and retaining the magnet 170. Although not shown in this example, the insulators 150, 160 can include vent openings to facilitate the flow of gases out from the open area 126. The back insulator 150 can partially surround the magnet 170 as shown, or alternatively fully surround the magnet 170.

As generally shown by the bi-directional arrows in FIGS. 3 and 4, the side walls 112 can be arranged relative to a respective outer side of the non-magnetic body 110. The proximity of each side wall 112 to a respective side of the body 110 as well as its dimension, shape or size can be configured according to the arc chute design, such as whether a front/side insulator 160 is to be utilized, whether side gas channels are incorporated, the size and shape of the plates of the body 110, the configuration of an arc chamber including its housing, and so forth. In various example embodiments, the side walls 112 can be formed by inserting the arc chute inside of the arc chamber (e.g., side-walls of the arc chamber become the side-walls of the arc chute) or side walls can be created from an insulating material which can also be used to support the stack of plates.

Figure 5:
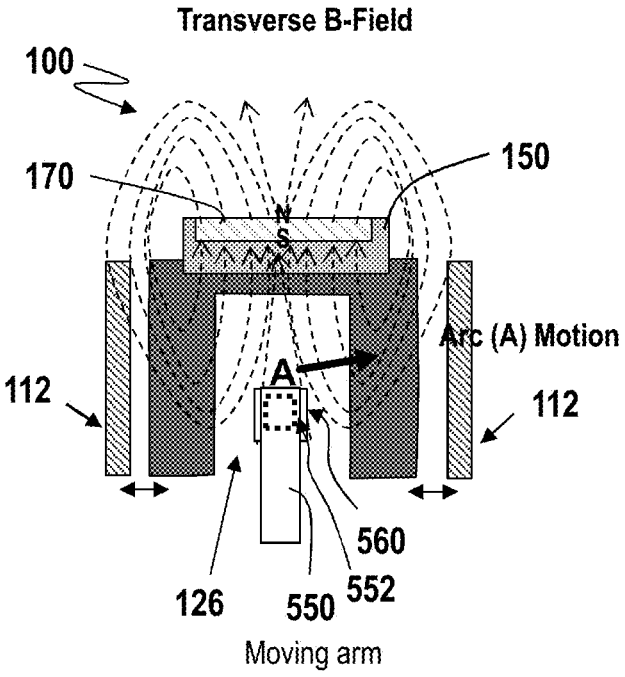
FIGS. 5 and 6 illustrate a top-sectional view and a side-sectional view, respectively, of the arc chute of FIG. 2 with the magnet field of the magnet redirecting an arc (or arcing), such as from operation of electrical contacts of a circuit protective device, to a side wall of the arc chute in accordance with the first embodiment.
Figure 6:
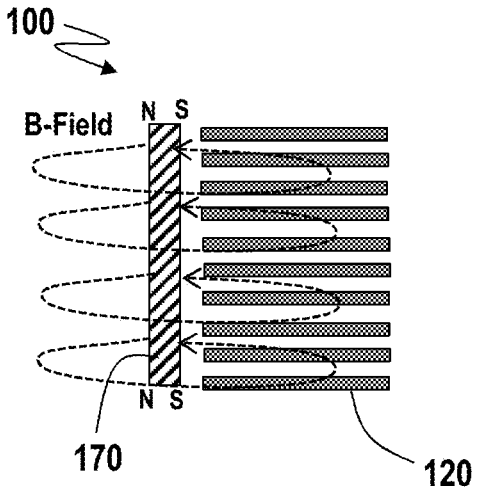

As shown in FIGS. 5 and 6, the magnet 170 can generate a magnet field(s), as generally indicated by the example field lines, around the arc chute 100 and across the open area 126. In this example, one magnetic pole (e.g., North (N) or South (S)) of the magnet at one end/side is configured to face the direction of the open space 126 and the opposite magnetic pole at an opposing end/side faces away from the open space 126. A moving arm 550 of a contact assembly of a circuit protective device can include or carry a moving electrical contact 552 (on an underside generally identified by broken lines). The moving arm 550 can pass through the open area 126 to engage or disengage from another electrical contact 560 (e.g., a stationary contact) of a contact assembly of the circuit protective device to enable or interrupt current flow, respectively. The electrical contact 560 can be arranged below (e.g., immediately below) the arc chute 100. When arcing is produced in the open area 126 between the electrical contacts 552 and 560 (e.g., as the moving electrical contact 552 disengages from the contact 560 and moves through the open area 126), the resulting arc is redirected by the magnetic field generated by the magnet 170 toward one of the pair of side walls 112 to extinguish the arc.

Figure 7:
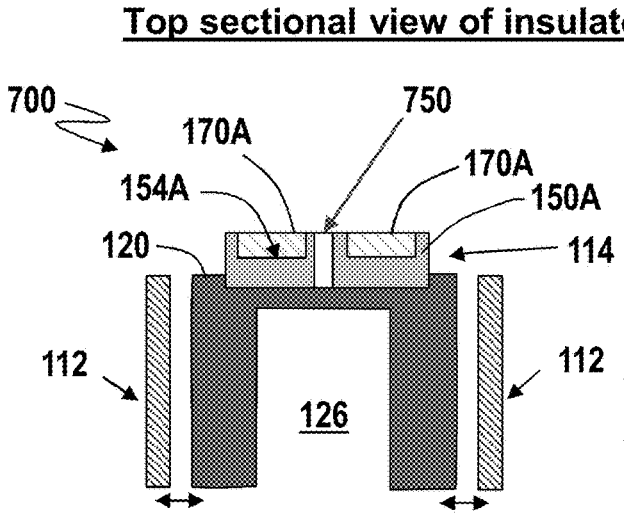
FIG. 7 is a top-sectional view of an arc chute in which a back insulator includes a vertical vent opening and supports a plurality of vertical magnets in accordance with the second embodiment.
Figure 8:
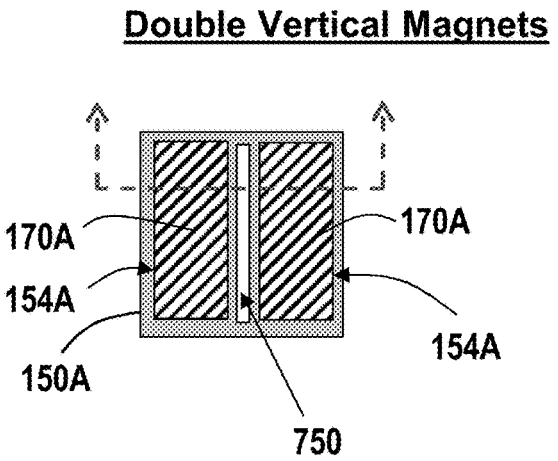
FIG. 8 is a partial back view of the arc chute of FIG. 7 showing the back insulator in accordance with the second embodiment.

FIG. 7 is a top-sectional view of a portion of an arc chute 700 in accordance with a second embodiment. The arc chute 700 can include the same or similar components as the arc chute 100 of FIG. 1, except that a back insulator 150A can include at least one vertical vent opening 750 (e.g., opening, slot, through-hole, etc.) and can support a plurality of vertical magnets 170A in respective pockets 154A as shown in FIGS. 7 and 8. The vertical vent opening(s) 750 can facilitate the flow of gases out from the open area 126. The arc chute 700 can also include additional front/side insulators (e.g., 160 in FIG. 1 or others described herein) arranged on an outer surface of the side walls 112.

Figure 9:
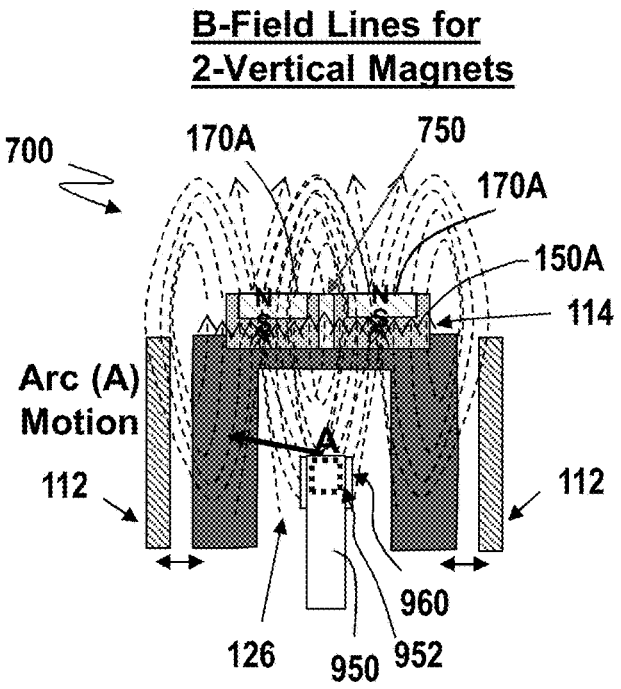
FIGS. 9 and 10 illustrate a top-sectional view and a side-sectional view, respectively, of the arc chute of FIG. 7 with the magnet field of the magnet redirecting an arc, such as from operation of electrical contacts of a circuit protective device, to a side wall of the arc chute in accordance with the second embodiment.
Figure 10:
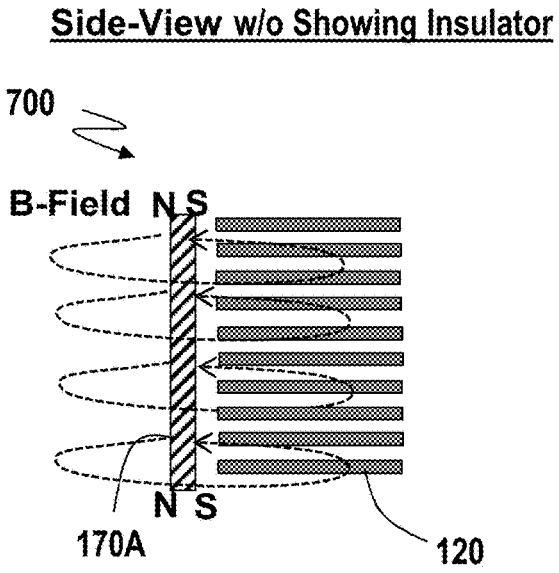

As shown in FIGS. 9 and 10, the magnets 170A can generate magnet fields, as shown by the example field lines, around the arc chute 700 and across the open area 126. In this example, a moving arm 950 of a circuit protective device can include or carry a moving electrical contact 952 (on an underside generally identified by broken lines). The moving arm 950 can pass through the open area 126 to engage or disengage the moving electrical contact 952 to or from another electrical contact 960 (e.g., a stationary contact), respectively, of the circuit protective device to enable or interrupt current flow, respectively. When arcing is produced in the open area 126, the resulting arc(s) can be redirected by the magnetic fields generated by the magnets 170A toward one of the pair of side walls 112 to extinguish the arc(s).

Figure 11:
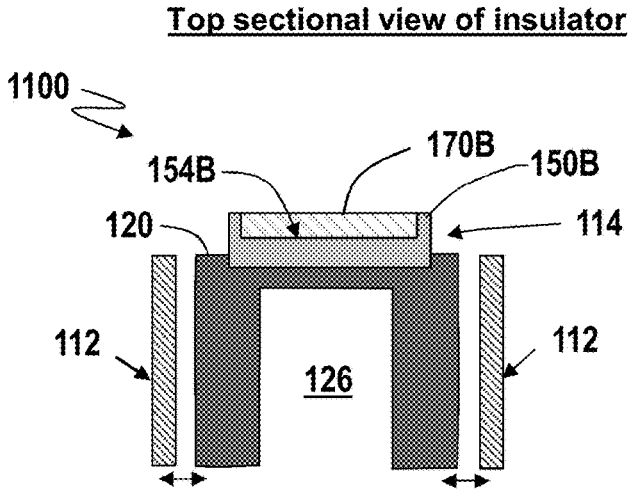
FIG. 11 is a top-sectional view of an arc chute in which a back insulator includes a horizontal vent opening and supports a plurality of horizontal magnets in accordance with the third embodiment.
Figure 12:
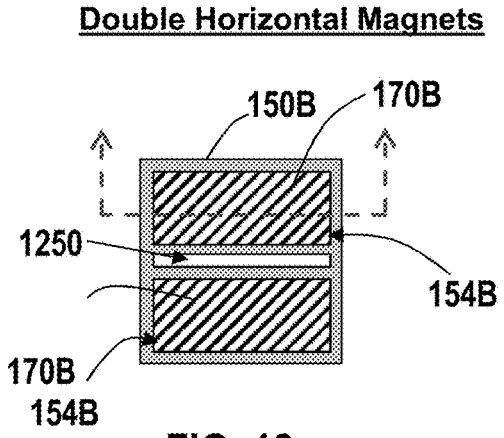
FIG. 12 is a partial back view of the arc chute of FIG. 11 showing the back insulator in accordance with the third embodiment.

FIG. 11 is a top-sectional view of a portion of an arc chute 1100 in accordance with a third embodiment. The arc chute 1100 can include the same or similar components as the arc chute 100 of FIG. 1, except that a back insulator 150B can include at least one horizontal vent opening 1250 and can support a plurality of horizontal magnets 170B in respective pockets 154B as shown in FIGS. 11 and 12. The horizontal vent opening(s) 1250 (e.g., in FIG. 12) can facilitate the flow of gases out from the open area 126. The arc chute 1100 can also include additional front/side insulators (e.g., 160 in FIG. 1 or others described herein) arranged on an outer surface of the side walls 112.

Figure 13:
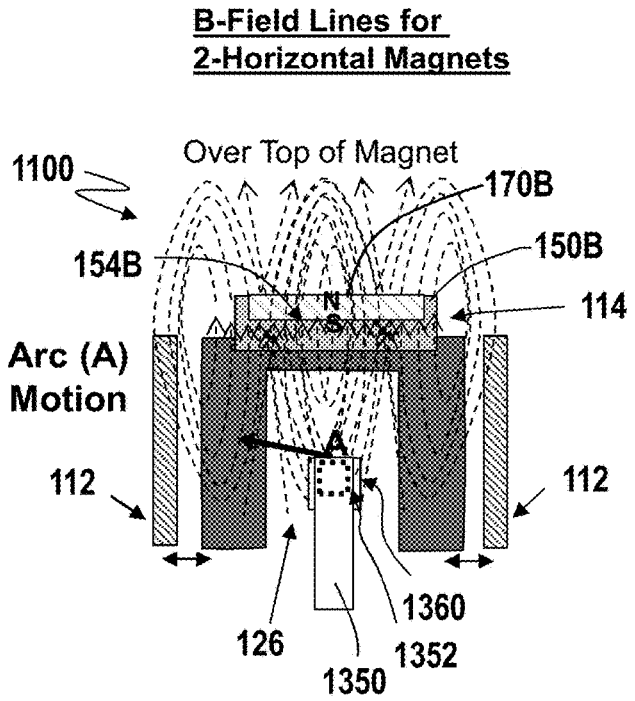
FIGS. 13 and 14 illustrate a top-sectional view and a side-sectional view, respectively, of the arc chute of FIG. 11 with the magnet field of the magnet redirecting an arc, such as from operation of electrical contacts of a circuit protective device, to a side wall of the arc chute in accordance with the third embodiment.
Figure 14:
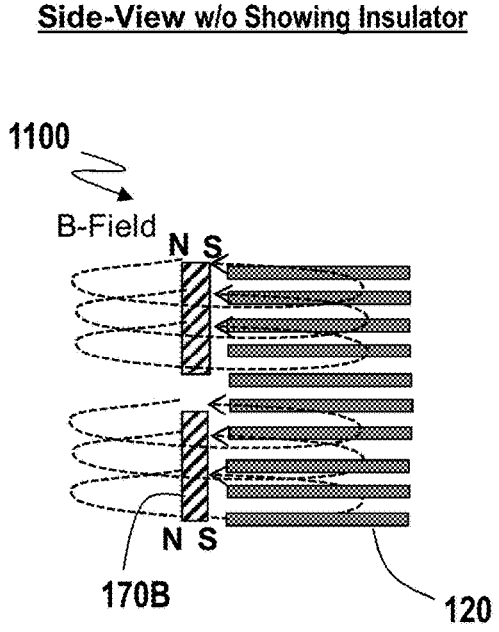

As shown in FIGS. 13 and 14, the magnets 170B can generate a magnet field(s), as shown by the example field lines, around the arc chute 1100 and across the open area 126. In this example, a moving arm 1350 of a circuit protective device can include or carry a moving electrical contact 1352 (on an underside generally identified by broken lines). The moving arm 1350 can pass through the open area 126 to engage or disengage the moving electrical contact 1352 to and from another electrical contact 1360 (e.g., a stationary contact), respectively, of the circuit protective device to enable or interrupt current flow, respectively. When arcing is produced in the open area 126, the resulting arc(s) can be redirected by the magnetic fields generated by the magnet 170B toward one of the pair of side walls 112 to extinguish the arc(s).

Various examples of the back insulator is shown and described above with reference to FIGS. 1 through 14. It should, however, be understood that the back insulator can be formed as a single piece or multiple pieces, and can be configured with vent openings and magnets at desired positions on or along a back wall of the arc chute. For example, the back insulator can have vertical and/or horizontal vent openings and/or openings having other dimensions, shape or sizes. The vent openings for the back and other insulators can be arranged (or positioned) to correspond with the slots on the non-magnet body (e.g., 110) or components of the arc chute. Other example insulator configurations, such as for the front/side insulators, will be described below with reference to the examples FIGS. 16-20. Furthermore, the side walls (or portions thereof) of the arc chute may be arranged against or in proximity to an outer side of the non-magnetic body according to the arc chute design.

Figure 15:
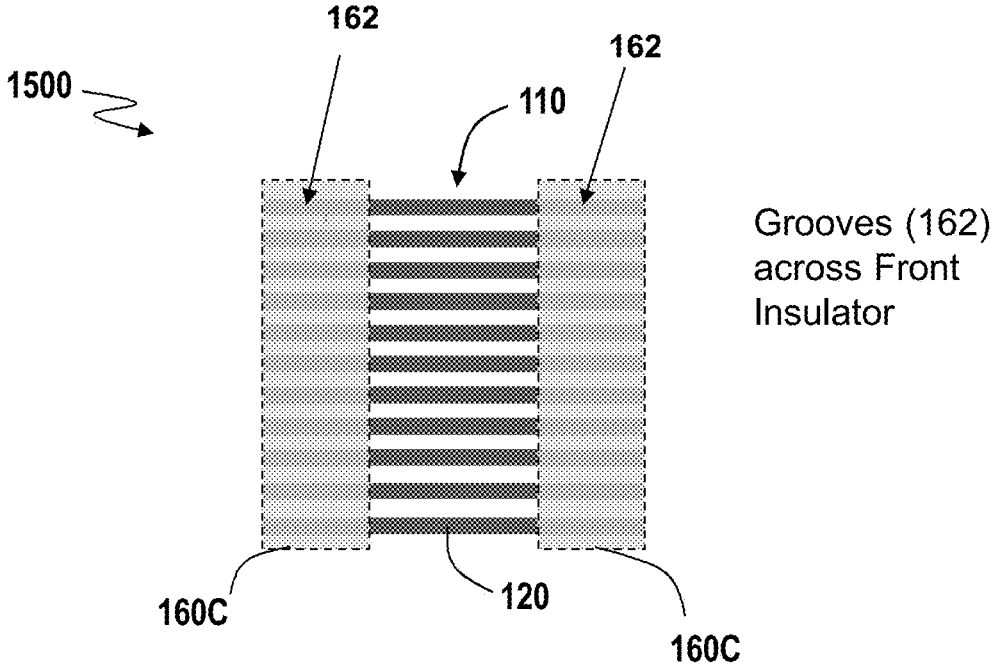
FIGS. 15 and 16A illustrate front and top views of an arc chute (shown without the back insulator and magnet(s)) with front insulators positioned across a face of an open end of each arm of the arc chute in accordance with a fourth embodiment.
Figure 16A:
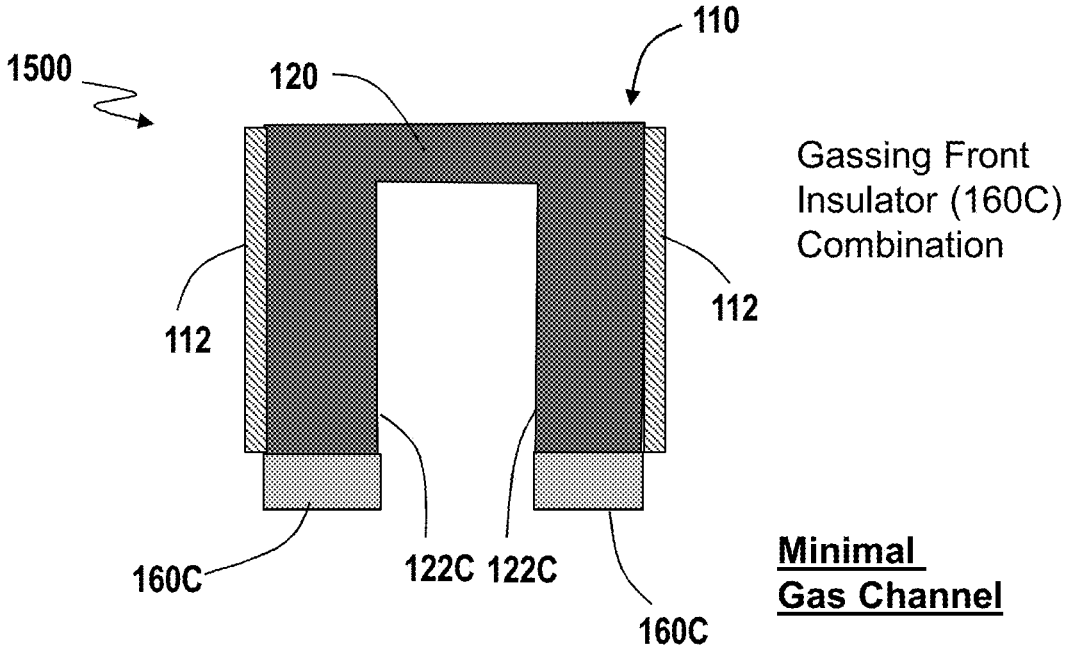

FIGS. 15 and 16A illustrate front and top views, respectively, of some of the components of an arc chute 1500 in accordance with a fourth embodiment. The arc chute 1500 can include the same or similar components as the arc chute 100 of FIG. 1, except that a front insulator 160C can be arranged across a face (or front) of an open end of each side wall 112. In this example, the body 110 includes a plurality of spaced-apart stacked plates 120, which are received and held within the grooves or recesses 162 of the insulators 160C. The width of the front insulator 160C can correspond to a width of a respective arm 122C of the body 120 (e.g., a width of a face of an open end of the arm 122C).

Figure 16B:
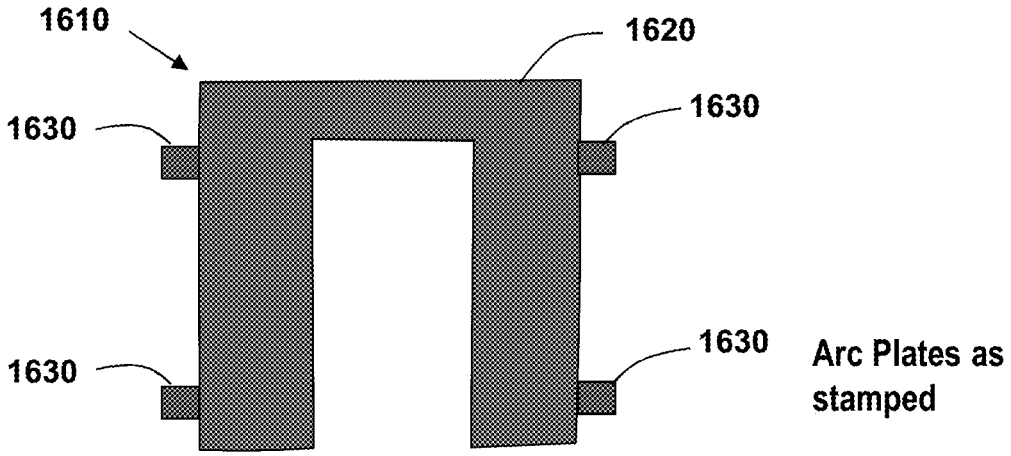
FIGS. 16B through 16D illustrate a process by which side walls can be provided on a non-magnetic body of an arc chute assembly in accordance with various embodiments.
Figure 16C:
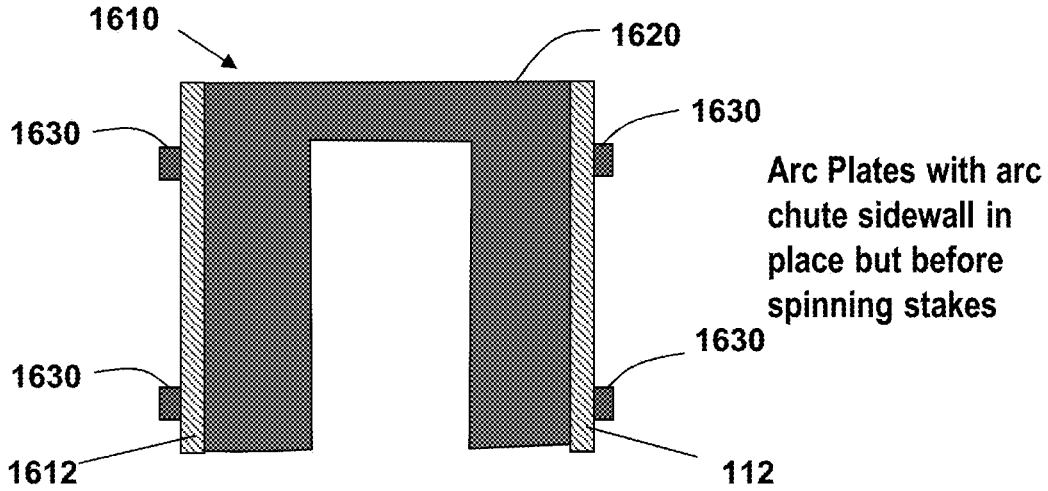
Figure 16D:
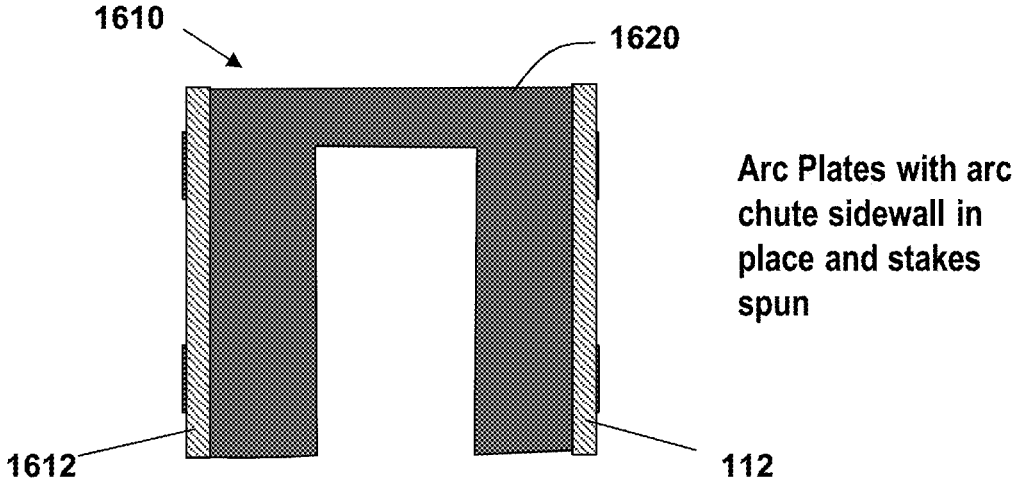

FIGS. 16B through 16D illustrate an example process for forming some of the components of an arc chute, such as the non-magnetic body and side walls, in accordance with various embodiments. As shown in FIG. 16B, each plate 1620 of a non-magnetic body 1610 can be formed with a plurality of stakes 1630 on an outer side portion of the plate. As shown in FIG. 16C, plates 1620 can then be staked to the side walls via the stakes 1630. As shown in FIG. 16D, the protruding portions of the stakes 1630 can be spun to reduce or remove them from the arc chute assembly. Thereafter, the back insulator and magnet(s) can be incorporated into the assembly, which can then be inserted into a case/housing of a circuit protective device (e.g., circuit breaker, contactor, etc.) to create an area generally referred to as the arc chamber. The arc chamber can include arc chute, venting, and contact assembly. The process described above is simply provided as an example for forming an arc chute in accordance with one or more embodiments such as described herein.

Figure 17:
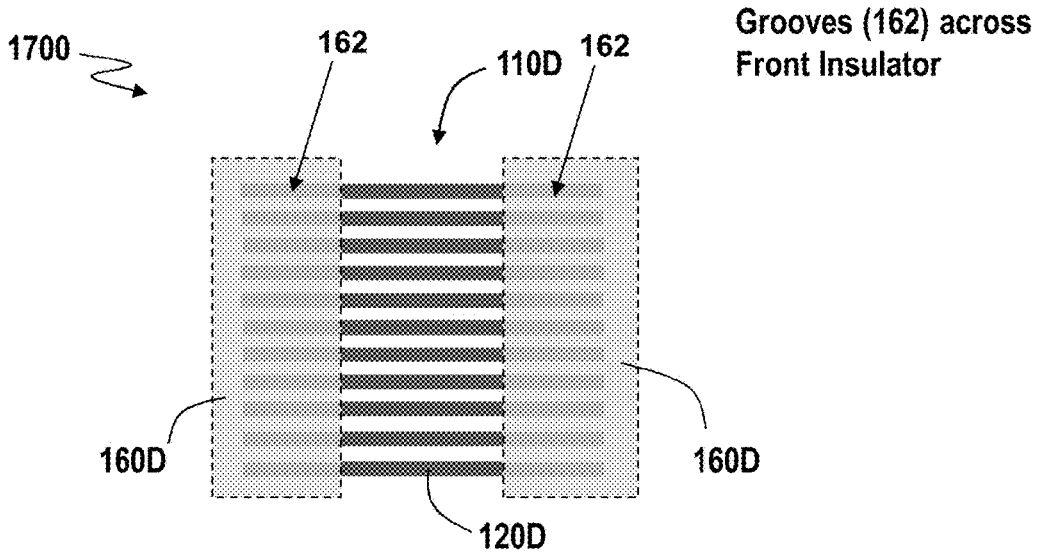
FIGS. 17 and 18A illustrate front and top views of an arc chute (shown without the back insulator and magnet(s)) with front insulators positioned across a face of an open end of each arm of the arc chute and vent channels formed along an outer surface of the side walls of the arc chute in accordance with a fifth embodiment.
Figure 18A:
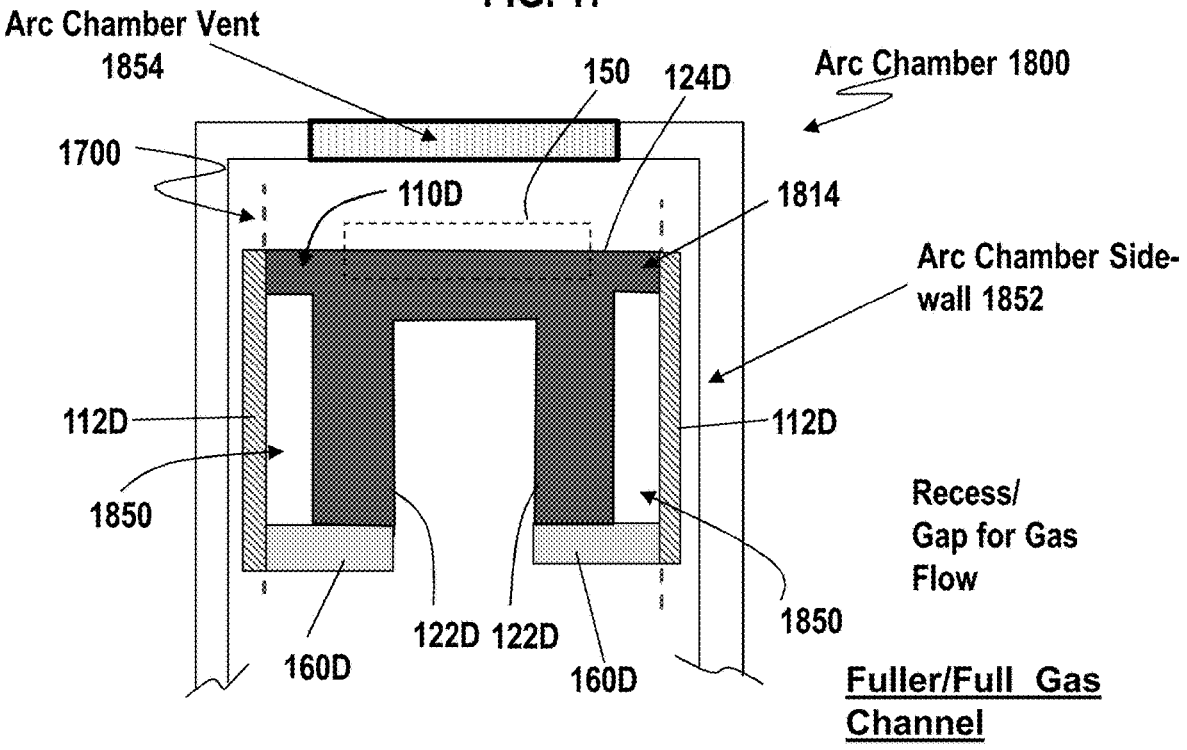

FIGS. 17 and 18A illustrate front and top views, respectively, of some of the components of an arc chute 1700, in accordance with a fifth embodiment. The arc chute 1700 can include the same or similar components as the arc chute 100 of FIG. 1, except that each front insulator 160D can be arranged across a face (or front) of an open end of a respective arm 122D of a non-magnetic body 110D, and the arc chute 1700 can be designed with side gas channels 1850 (e.g., a vertical recessed area or gap). In this example, the body 110D includes a plurality of spaced-apart stacked plates 120D, which are received and held within the grooves or recesses 162 of the insulators 160D. Extending portions (or moldings) 1814 of the base 124D of the body 110D can extend beyond an outer side of the arms 122D, and the front insulators 160D can also extend beyond a face (or front) of an open end of each of the arms 122D. The extending portions 1814 of the base 124D and the front insulators 160D together with an outer surface of the side walls 112D can form gas channels 1850 for directing gas flow, such as for example toward a vent or venting components of a circuit protective device. In this example, the gas channels are formed by a combination of portions of the non-magnetic body 110D and the front insulators 160D along with the side walls 112D. The body 110D can have a π-shaped profile.

As further shown in FIG. 18A, the assembly of the arc chute 1700 can be inserted into an arc chamber 1800 of a circuit protective device. In operation, gases produced as a result of arcing can be directed toward an arc chamber vent 1854 at a vent end (or back) of the arc chamber 1800. For example, some of the gases may be channeled from the side channels 1850 through slots at the base of the body 110 to the vent 1854. The circulation of the gases can help to further extinguish arc by cooling the arc.

Figure 18B:
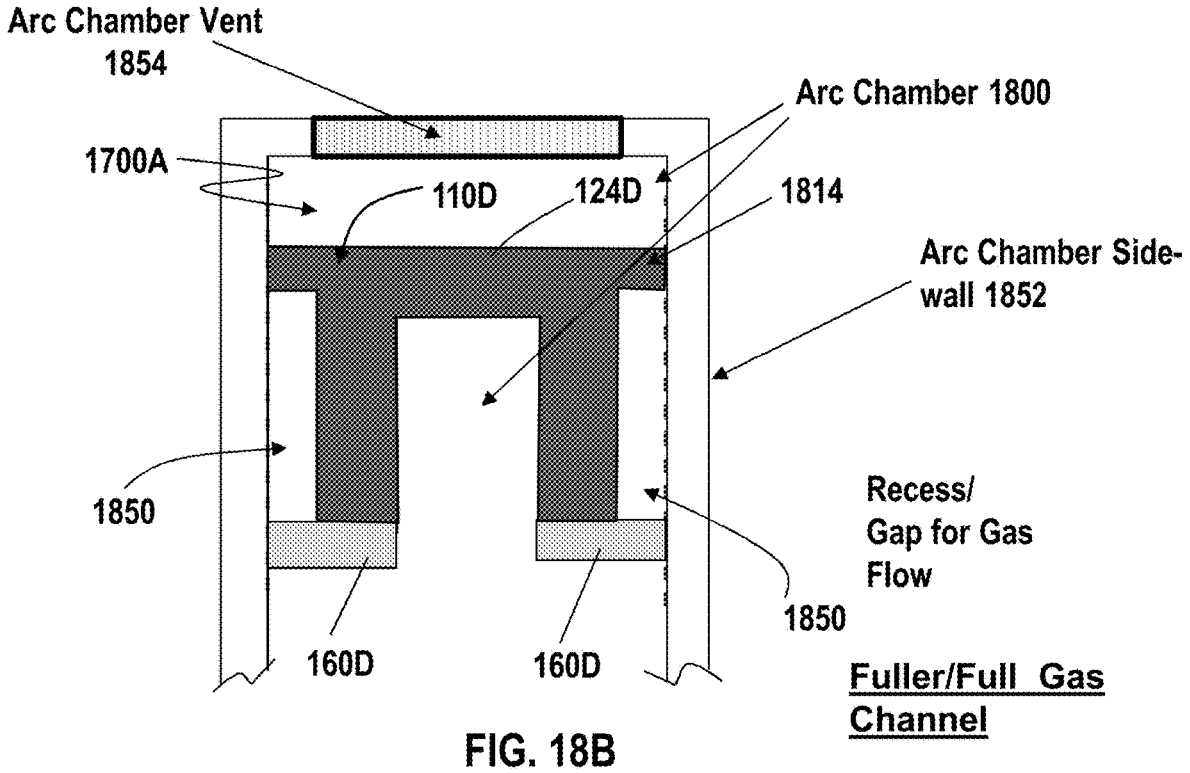
FIGS. 18B and 18C illustrate a top view of alternative example configurations of an arc chute of FIG. 18A in accordance with various embodiments.

FIG. 18B illustrates an arc chute 1700A, which is an alternative example arc chute configuration to the arc chute 1700 in FIG. 18A. As shown in FIG. 18B, side walls of the arc chute can be formed using side walls 1852 of the arc chamber 1800.

Figure 18C:
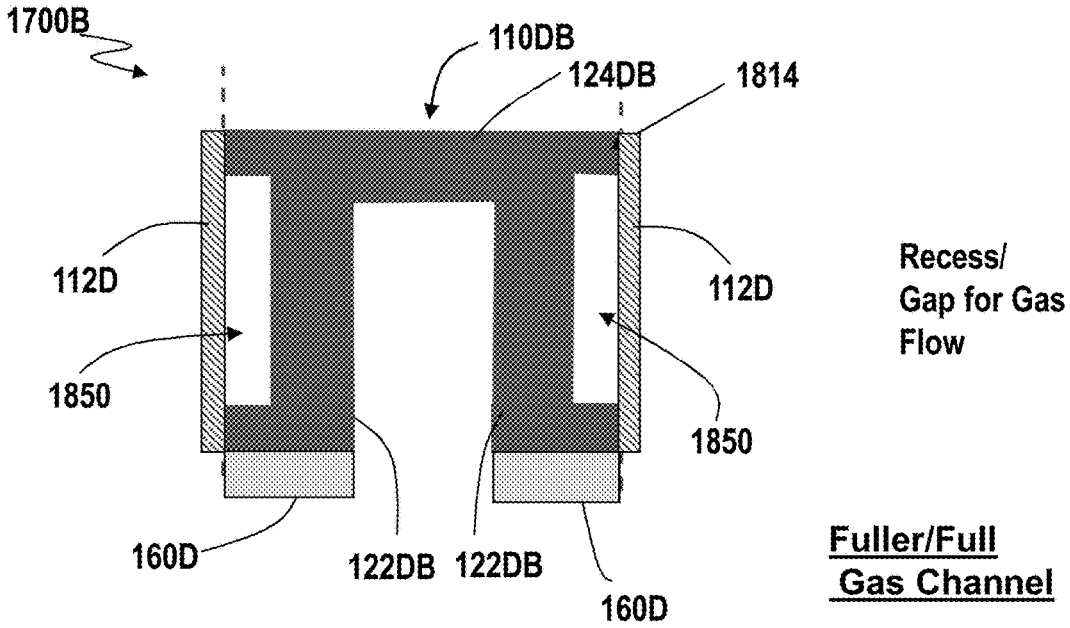

FIG. 18C illustrates an arc chute 1700B, which is another alternative example arc chute configuration to the arc chute 1700 in FIG. 18A. As shown in FIG. 18C, the non-magnetic body 110DB includes a recessed area on each outer side of the body, which together with the side wall (e.g., 112D) form side channels 1850 for directing gas flow, such as for example toward a vent or venting components of a circuit protective device.

Figure 19:
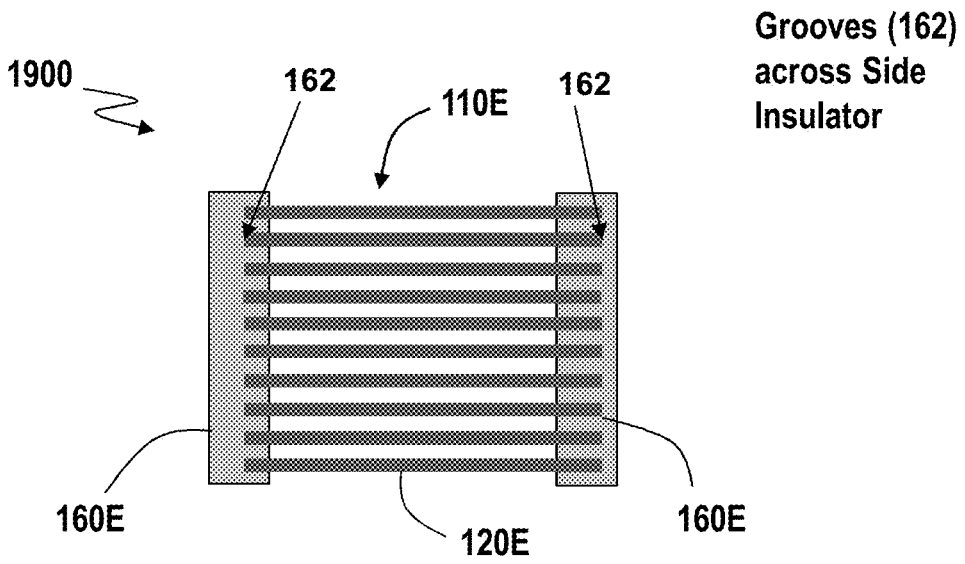
FIGS. 19 and 20 illustrate front and top views of an arc chute (shown without the back insulator and magnet(s)) with side insulators positioned at an outer side of an end of each arm of the arc chute and vent channels formed along an outer surface of the side walls of the arc chute in accordance with a sixth embodiment.
Figure 20:
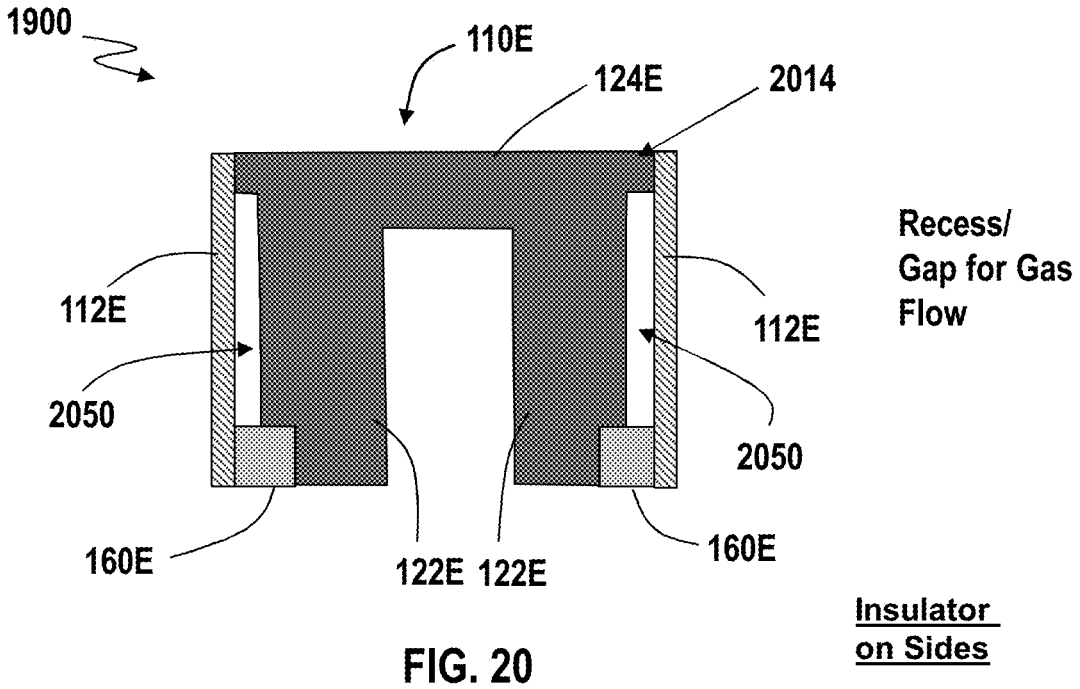

FIGS. 19 and 20 illustrate front and top views, respectively, of some of the components of an arc chute 1900 in accordance with a sixth embodiment. The arc chute 1900 can include the same or similar components as the arc chute 100 of FIG. 1, except that each side insulator 160E can be arranged on a side of a front of an open end of an arm 122E of a non-magnetic body 110E, and the arc chute 1900 can be designed with a side gas channel 2050 (e.g., a vertical recessed area or gap) on its side(s). In this example, the body 110E includes a plurality of spaced-apart stacked plates 120E, which are received and held within the grooves or recesses 162 of the insulators 160E. Extending portions (or moldings) 2014 of the base 114E of the body 110E can extend beyond an outer side of the side walls 112E, and the side insulators 160E can also extend from an outer side of each of the arms 122E of the body 110E. The side insulators 160E and the extending portions 2014 of the base 114E together with the side walls 112E can form gas channels 2050 for directing gas flow, such as toward a vent or venting components of a circuit protective device. In this example, the body 110E can have a π-shaped profile.

In various examples described herein the gas channels can be formed by a combination of portions of the non-magnetic body and the front/side insulators (e.g., FIGS. 17-20), with a desired shape and direction. However, gas channel(s) can be formed by configuring a shape of the outer surface of the non-magnetic body (e.g., the stacked plates) with one or more vertical or horizontal recesses or gaps or a combination thereof on the outer surface of the walls (e.g., side and/or back walls), and/or through the use of additional insulators spaced-apart along an outer surface of the non-magnetic body. The arc chute design can also have tabs designed in as part of the metal plate and then staked or spun down to an insulator piece. The grooves (e.g., grooves, recesses, slots, etc.) of the insulators, which are configured to receive and support the plates of the non-magnetic body of the arc chute as well as separate and isolate the plates from each other, can be formed by stamping, cutting, molding or other manufacturing techniques. In general, the insulators and the non-magnet body can be joined using corresponding male and female parts (e.g., tongue and groove) for joining components, with the male part or the female part on the insulator or the non-magnetic body. Furthermore, each plate of the non-magnetic body can be formed as one piece or a plurality of pieces. For example, the pair of arms of each plate can be separate pieces, which are connected to the back insulator for support. In addition, the various components of the arc chute (e.g., non-magnetic body, insulator(s), side walls, back wall, etc.) can be connected together using various techniques, including but not limited to male/female connectors on the components, adhesives, stakes or staking, or other manufacturing techniques for joining components together.

The arc chute as described herein can be used with different types of circuit protective devices, including but not limited to a molded case circuit breaker (MCCB), miniature circuit breaker (MCB), unidirectional or bi-directional circuit breaker, circuit breaker with a single or double-arm moving assembly, and so forth. The circuit breaker can incorporate one or two arc chutes or any desired number of arc chutes depending on various factors, such as the number of breaker arms, sets or pairs of electrical contacts, and so forth. For example, a circuit breaker with a double breaker arm assembly for two sets of electrical contacts can employ two arc chutes, e.g., one for each set of moving and stationary contacts. The size, shape, dimension and location of the various components or parts of the arc chute assembly (e.g., magnets, insulators, non-magnetic body, slots, openings, channels, recesses, recessed portions, recessed areas, etc.) can be varied to satisfy safety requirements, or according to the size or type of the circuit breakers or the particular application.

It should be understood that the example embodiments disclosed and taught herein are susceptible to numerous and various modifications and alternative forms. Thus, the use of a singular term, such as, but not limited to, "a" and the like, is not intended as limiting of the number of items.

In the preceding, reference is made to various embodiments. However, the scope of the present disclosure is not limited to the specific described embodiments. Instead, any combination of the described features and elements, whether related to different embodiments or not, is contemplated to implement and practice contemplated embodiments. Furthermore, although embodiments may achieve advantages over other possible solutions or over the prior art, whether or not a particular advantage is achieved by a given embodiment is not limiting of the scope of the present disclosure. Thus, the preceding aspects, features, embodiments and advantages are merely illustrative and are not considered elements or limitations of the appended claims except where explicitly recited in a claim(s).

It is to be understood that the above description is intended to be illustrative, and not restrictive. Many other implementation examples are apparent upon reading and understanding the above description. Although the disclosure describes specific examples, it is recognized that the systems and methods of the disclosure are not limited to the examples described herein, but may be practiced with modifications within the scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

I claim:

1. An apparatus for extinguishing an arc, comprising:

an arc chute including:

a pair of opposing side walls formed of an electrically insulating material;

a non-magnetic body arranged between the side walls, the non-magnetic body having an open area and a plurality of slots through which to facilitate gas flow;

a back wall arranged on a back side of the non-magnetic body, the back wall including at least one first insulator and at least one magnet, the at least one first insulator being arranged between the at least one magnet and the open area and configured to electrically isolate the magnet from the non-magnetic body, the magnet generating a magnetic field to redirect an arc in the open area toward one of the side walls.

2. The apparatus of claim 1, wherein the non-magnetic body comprises a plurality of stacked metal plates which are spaced-apart to form the plurality of slots therebetween.

3. The apparatus of claim 2, wherein each plate of the plurality of stacked metal plates has a pair of arms extending from a base which is connected therebetween, the open area being formed between the pair of arms of the stacked metal plates.

4. The apparatus of claim 3, wherein each plate of the plurality of stacked metal plates has a U-shaped profile or π-shaped profile.

5. The apparatus of claim 3, wherein the at least one first insulator includes a plurality of spaced apart grooves or recesses configured to engage and support an outer surface of the base of corresponding plates from the plurality of stacked metal plates, and is configured to support the at least one magnet.

6. The apparatus of claim 5, wherein the at least one first insulator includes one or more vent openings through which to facilitate gas flow out from the open area.

7. The apparatus of claim 6, wherein the at least one magnet has a first end and an opposite second end, the first and second ends each having an opposite magnetic polarity, one of the first or second end facing toward the open area across the at least one first insulator.

8. The apparatus of claim 5, wherein the at least one first insulator includes at least one pocket for supporting the at least one magnet.

9. The apparatus of claim 5, wherein the at least one first insulator includes one or more vent openings through which to facilitate gas flow out from the open area, the at least one magnet comprises a plurality of magnets, and the at least one first insulator includes a plurality of pockets for supporting the plurality of magnets at different locations, the plurality of pockets being separated by the one or more vent openings.

10. The apparatus of claim 3, further comprising a pair of second insulators each including a plurality of spaced apart grooves or recesses configured to engage and support corresponding plates from the plurality of stacked metal plates, each second insulator being engaged to the plurality of plates of a respective one of the pair the side walls.

11. The apparatus of claim 10, wherein each of the pair of second insulators are configured to engage an open end of a corresponding arm of the pair of arms.

12. The apparatus of claim 10, wherein the arc chute includes at least one side gas channel.

13. The apparatus of claim 10, wherein the second insulators comprises nylon.

14. The apparatus of claim 1, wherein the first insulator comprises nylon.

15. A circuit protective device, comprising:

a first electrical contact;

a movable second electrical contact, which when engaged with the first electrical contact, is configured to enable current flow thereacross to a circuit; and the apparatus of claim 1, wherein the second electrical contact is configured to move through the open area of the non-magnetic body of the arc chute to engage or disengage from the first electrical contact.

16. The circuit protective device of claim 15, further comprising:

a case for housing the first and second electrical contacts, and the arc chute.

17. The circuit protective device of claim 15, wherein the side walls of the arc chute is formed as part of the case or side walls of an arc chamber in the case.

18. The circuit protective device of claim 15, wherein the device is a bi-directional circuit breaker.

19. The circuit protective device of claim 15, wherein the device is a DC circuit breaker.

20. The apparatus of claim 1, wherein the non-magnetic body comprises a plurality of stacked metal plates which are spaced-apart to form the plurality of slots therebetween, and wherein the at least one first insulator of the back wall includes a plurality of spaced apart grooves or recesses configured to engage and support an outer surface of corresponding plates on a back of the plurality of stacked metal plates, and is configured to support the at least one magnet.

* * * * *